US008943755B2

(12) United States Patent
Herlihy et al.

(10) Patent No.: US 8,943,755 B2
(45) Date of Patent: Feb. 3, 2015

(54) INSULATING COVER FOR A/C UNIT

(71) Applicant: Green Sentry Solutions, Inc., New Rochelle, NY (US)

(72) Inventors: Randall Herlihy, Croton-on-Hudson, NY (US); Robert Feuer, New Rochelle, NY (US); Paul Fiore, White Plains, NY (US)

( * ) Notice: Subject to any disclaimer, the term of this patent is extended or adjusted under 35 U.S.C. 154(b) by 0 days.

(21) Appl. No.: 13/835,365

(22) Filed: Mar. 15, 2013

(65) Prior Publication Data

US 2013/0291440 A1 Nov. 7, 2013

Related U.S. Application Data

(60) Provisional application No. 61/641,034, filed on May 1, 2012, provisional application No. 61/692,898, filed on Aug. 24, 2012.

(51) Int. Cl.
*F24F 13/20* (2006.01)
*F24F 1/02* (2011.01)

(52) U.S. Cl.
CPC .. *F24F 13/20* (2013.01); *F24F 1/02* (2013.01)
USPC ..... 52/3; 52/202; 62/262

(58) Field of Classification Search
CPC ..... F24F 13/20; F24F 13/24; E04F 11/06; E06B 2009/005; E06B 9/00; E06B 1/34
USPC ..... 52/3, 19, 202, 203; 150/165; 160/39, 160/352, 368.1, 369
See application file for complete search history.

(56) References Cited

U.S. PATENT DOCUMENTS

| | | | | | |
|---|---|---|---|---|---|
| 4,202,389 | A * | 5/1980 | Ewald | 150/165 |
| 4,281,743 | A * | 8/1981 | Fuller | 182/46 |
| 4,308,905 | A * | 1/1982 | Gallagher | 150/165 |
| 4,332,114 | A * | 6/1982 | Goebel et al. | 62/262 |
| 4,378,082 | A * | 3/1983 | Chica | 224/243 |
| 4,555,983 | A * | 12/1985 | Bolton et al. | 454/330 |
| 4,788,805 | A * | 12/1988 | Shaw | 52/202 |
| 4,832,153 | A * | 5/1989 | Daw et al. | 182/46 |
| 4,928,441 | A * | 5/1990 | Daley | 52/19 |
| 5,125,197 | A * | 6/1992 | Fuchs | 52/202 |
| 5,307,849 | A * | 5/1994 | Nelson | 150/165 |
| 5,341,860 | A * | 8/1994 | Klein | 150/165 |
| 5,475,955 | A * | 12/1995 | Dickinson | 52/202 |
| 6,014,841 | A * | 1/2000 | McCoy et al. | 52/19 |
| 6,061,981 | A * | 5/2000 | Nieves | 52/202 |
| 6,601,352 | B1 * | 8/2003 | Obermeyer et al. | 52/202 |
| 7,328,589 | B2 * | 2/2008 | Boone | 62/262 |
| 2010/0325974 | A1 * | 12/2010 | Shapero | 52/169.14 |
| 2011/0247398 | A1 * | 10/2011 | Breed | 73/40.5 R |

FOREIGN PATENT DOCUMENTS

GB 2 216 935 A * 10/1989

* cited by examiner

*Primary Examiner* — Robert Canfield
(74) *Attorney, Agent, or Firm* — Donald J. Ranft; Kristen A. Mogavero; Collen IP

(57) ABSTRACT

Embodiments disclose an apparatus for enclosing and insulating an opening in a structure such as for an air conditioning unit or a sleeve. The apparatus includes a cover having a first section and a second section, wherein the first section is designed to be adjustable in relation to the second section; one or more insulating members positioned along an interior of the cover; two or more fasteners designed to secure the cover to an A/C unit sleeve or a structure. In another embodiment the apparatus cover is a single section and not adjustable. A method of installing the same is provided, as are other aspects.

8 Claims, 5 Drawing Sheets

INSULATING COVER FOR A/C UNIT

CROSS-REFERENCE TO RELATED APPLICATIONS

The present application claims priority to commonly-assigned, co-pending U.S. Provisional Patent Application Ser. No. 61/641,034, filed May 1, 2012, and entitled "INSULATING COVER FOR A/C UNIT," and U.S. Provisional Patent Application Ser. No. 61/692,898, filed Aug. 24, 2012, and entitled "INSULATING COVER FOR A/C UNIT," which are hereby incorporated herein by reference in their entirety for all purposes.

FIELD

The present invention relates generally to accessories used with air conditioning units and equipment, and more particularly to an insulating cover for an air conditioning unit or sleeve.

BACKGROUND

Some buildings and structures ("building") may include an opening or passage in an exterior wall thereof that passes from outside the building to inside a room in the building, and is used to house or mount an air conditioning unit ("A/C unit"). The opening may be referred to as an air conditioning sleeve ("sleeve"). To replace the air conditioning (A/C) unit mounted in the sleeve, the old A/C unit may be slid out from the sleeve, and a new A/C unit may then be slid into the sleeve. However, there may be instances where it may not be desirable to install a new A/C unit for some amount of time after the old A/C unit has been removed. Typically, the open ends of the sleeve may be closed by fitting a metal cap over the ends to prevent air from entering or leaving the building through the sleeve.

In some instances, instead of mounting an A/C unit in a sleeve, an A/C unit may be mounted in an opening created by an open window. To prevent outside air from entering the room through the vents in the A/C unit, a cover, such as a quilted cover, may be placed over the window mounted A/C unit.

Both sleeve mounted and window mounted A/C units may be a major source of heat loss from a building or structure during cold winter months. A/C units are not air tight and may allow colder outside air to migrate through the A/C unit and into the building. Additionally, cold air can blow through the gap between the sleeve interior and the A/C unit, and gaps between the window and the window-mounted A/C unit. The inability to prevent cold outside air from entering the building may result in a colder interior room, a loss of energy due to greater use of the heating equipment in the building, and increased expense.

While weatherization products, such as caulk or foam strips, for example, may be used, the air leakage gaps described above may still exist. Further, these weatherization products do not prevent the outside air from flowing through the A/C unit. Conventionally, people have used pillows, roll plastic, garbage bags with duct tape and textile A/C unit covers to try to prevent the outside air from flowing through the A/C unit. However, these products still typically allow outside air to flow inside, as the seal between the products and the sleeve or window may not be sealed to be air-tight.

Accordingly, there is a need for an improved cover for an air conditioning unit.

SUMMARY

In a first aspect, an apparatus is provided. The apparatus comprises a cover having a first section and a second section, wherein the first section is designed to be secured to the second section; one or more insulating members positioned along an interior of the cover; and two or more fasteners designed to secure the cover to a structure in which the A/C unit or A/C unit sleeve are inserted. The apparatus can also be attached directly the A/C unit or the A/C unit sleeve.

According to another aspect, a method is provided. The method comprises determining a target length of a cover; adjusting the length of the cover to equal the determined target length; fastening a first section of the cover to a second section of the cover to maintain the determined length; coupling one or more insulating members to a first surface of the cover; and securing the cover to a structure.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DETAILED DESCRIPTION

Figure 1:
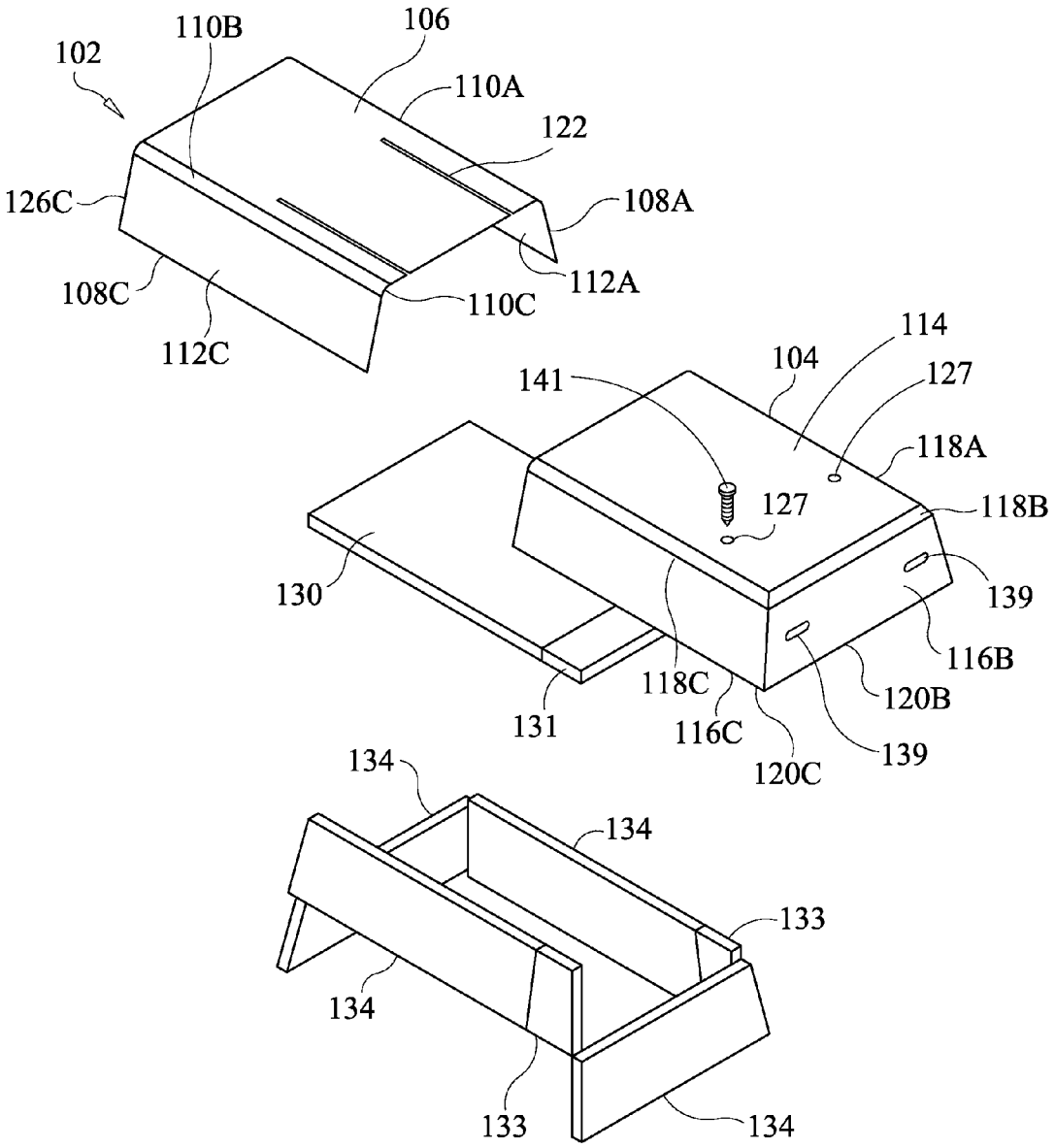
FIG. 1 illustrates an exploded view of the apparatus.
Figure 2:
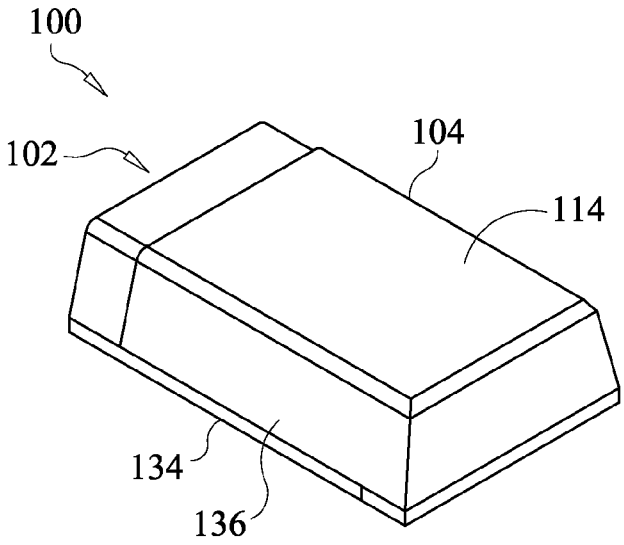
FIG. 2 illustrates an isometric view of the apparatus.
Figure 3:
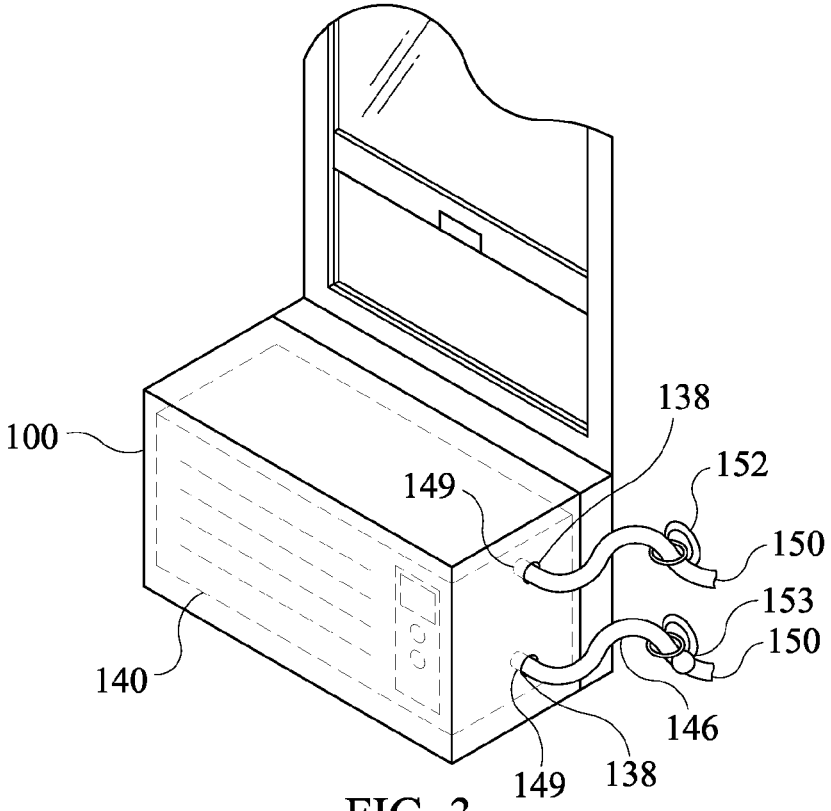
FIG. 3 illustrates the apparatus covering a window A/C unit.
Figure 4:
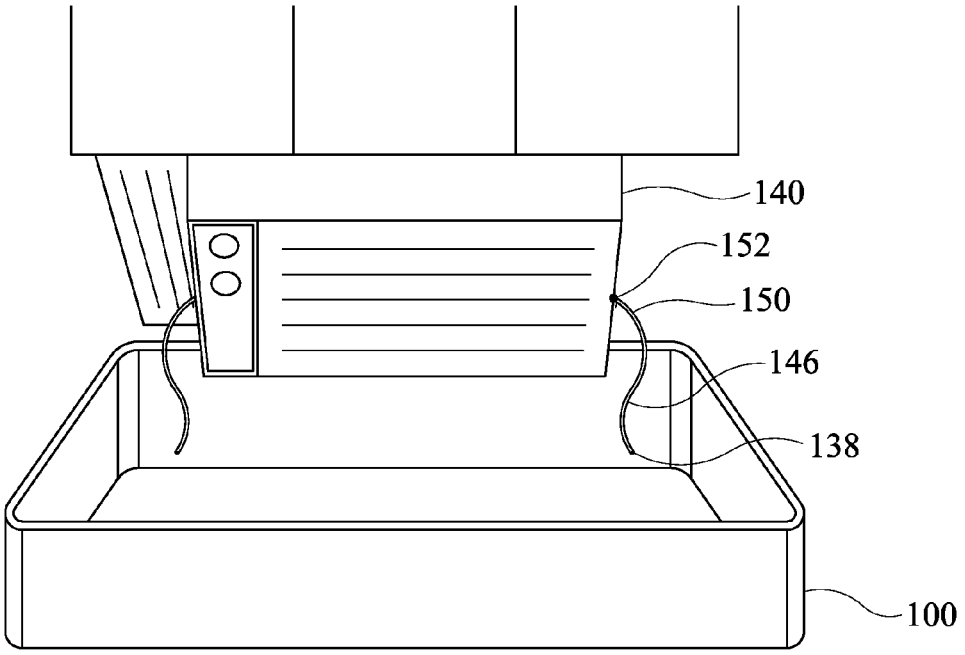
FIG. 4 illustrates an apparatus with fasteners attached to an A/C unit and ready to be secured over it.
Figure 5:
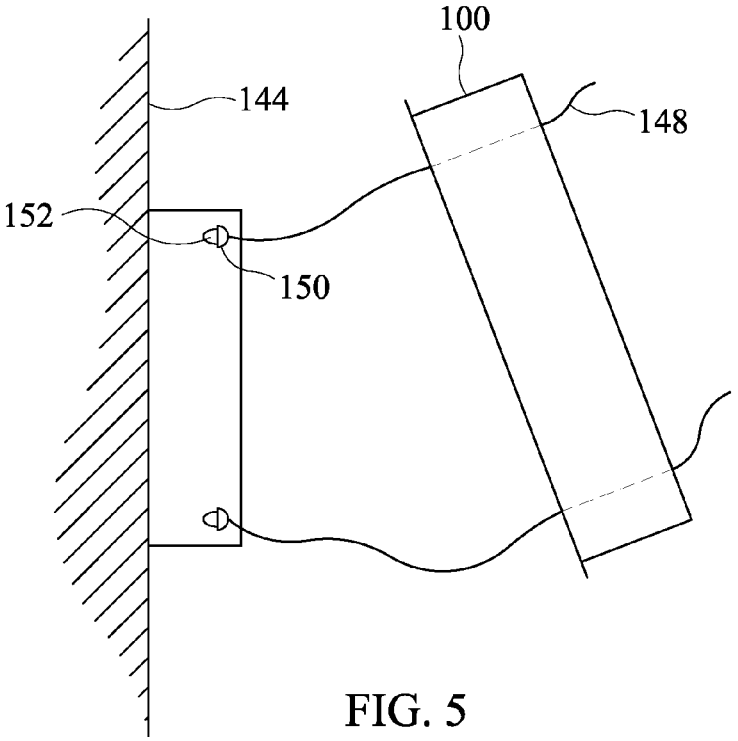
FIG. 5 is a side view of FIG. 4.
Figure 6:
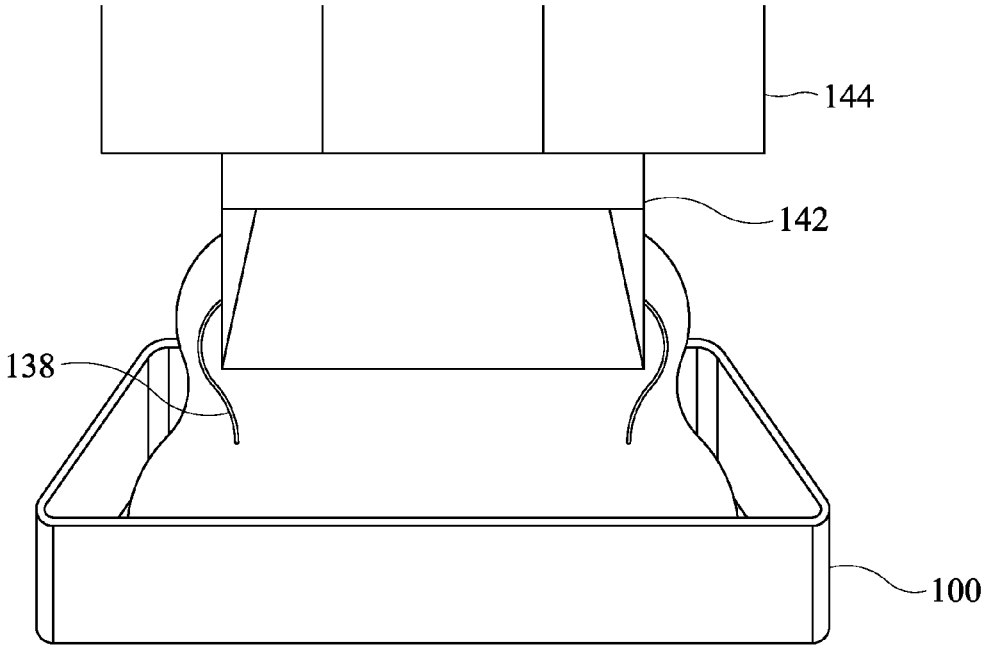
FIG. 6 illustrates an apparatus with fasteners attached to a sleeve and ready to be secured over it.
Figure 7:
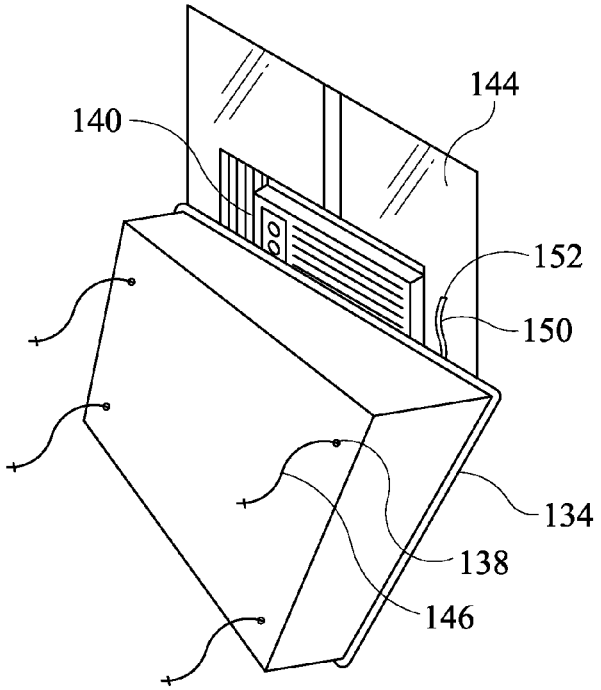
FIG. 7 illustrates an apparatus with fasteners attached to a wall and ready to be secured over a sleeve.

Embodiments of the present invention provide apparatus and methods for securing a cover over an opening in a structure. In particular the opening is for an A/C unit or A/C unit sleeve but this can also be used for other openings in structures. One embodiment of the present invention (FIGS. 1 and 2) provides an adjustable cover which fits over an A/C unit or sleeve and limits or eliminates air flow in and out of the A/C unit or sleeve. The length of the cover may be adjusted to accommodate different sized A/C units and sleeves. Additionally, the cover may be easily installed and removed. The length of the cover, if previously extended for use, can also be contracted for ease of storing when not in use but insulation may need to replaced when reinstalling.

In terms of window A/C units, the cover allows the A/C unit to remain in the window for all seasons, instead of removing the window A/C unit at the end of the A/C unit using season (e.g. fall, winter). Further, in terms of the sleeve, if no A/C unit is placed in the sleeve, the cover may remain over the sleeve indefinitely.

In another embodiment the apparatus is a single unit and not adjustable in size as shown on FIGS. 3-7.

These and other embodiments adapted to insulate an A/C unit or sleeve, and methods of installing the same are described below with reference to FIGS. 1-8. The drawings are not drawn to scale. Like reference numerals are used throughout the specification to denote like elements.

Referring now in specific detail FIGS. 1-7, an insulating cover apparatus 100 ("cover") in accordance with embodiments of the invention is shown. The terms "cover" and "shell" may be used throughout interchangeably. The term structure is broadly used to mean any enclosure which is usually a building but it could even be a device or a truck trailer for example. The term sleeve refers to a sleeve typically installed through a wall. An AC unit (or other device besides an air conditioning unit) is inserted into the sleeve. An AC unit refers to an air conditioner typically installed in a window. But the AC unit has an AC sleeve. Thus referring to a sleeve in this specification and claims refers to the sleeve intended to be located through a wall or the sleeve intended to be inserted into a window opening. In both cases the sleeves are designed for housing an A/C unit. But the sleeves can also be designed to house other non A/C units.

In one embodiment (FIGS. 1 and 2) the cover 100 includes a first section 102 and a second section 104. Each section may be 24 inches long for a typical A/C unit, or any other suitable length. The first section 102 is typically smaller than the second section 104. The cover 100 may be made from a semi-rigid material such as plastic that is vacuum formed and for example molded out of 0.125 mm plastic. Other suitable materials, thicknesses, and methods of formation may be used.

The first section 102 includes a first section major surface 106. The first section major surface 106 may be sized and shaped to approximately conform to a face of an A/C unit 140 or opening being covered. While the first section major surface 106 is shown herein having a rectangular shape, any suitable geometric shape may be used. The first section 102 also includes three side walls 108A, 108B (not shown), 108C, each extending substantially perpendicular from edges 110A, 110B, 110C to lower edges 112A, 112B and 112C respectively. The three side walls 108A, 108B, 108C may extend from three edges 110A, 110B, 110C at an angle of greater than or less than 90 degrees as warranted for a particular application. The length of the side walls 108A, 108B and 108C from the three edges 110A, 110B, and 110C, respectively, to lower edges 112A, 112B (not shown), 112C, is typically approximately six inches. Other suitable lengths may be used.

The second section 104 includes a second section major surface 114. The second section major surface 114 may be sized and shaped to approximately conform to a face of the A/C unit or opening being covered. While the second section major surface 114 is shown herein having a rectangular shape, any suitable geometric shape may be used. Similarly to the first section 102, the second section 104 also includes three side walls 116A (not shown), 116B, 116C, extending substantially perpendicular from three edges 118A, 118B, 118C to lower edges 116A, 116B, 116C. The three side walls 116A, 116B, 116C may extend from the three edges 118A, 118B, 118C of the second section major surface 114 at an angle of greater than or less than 90 degrees. The length of the side walls 116A, 116B and 116C from the three edges 118A, 118B, and 118C, respectively, to lower edges 120A (not shown), 120B, 120C, is typically approximately six inches. Other suitable lengths may be used.

The first section major surface 106 and two of its side walls 108A and 108C may include one or more grooves, slots, or tracks 122. While each surface shown herein includes two grooves, the number of grooves may be changed as warranted. The grooves extend along the surfaces in the direction of movement of the first section in relation to the second section when the two sections are joined. Thus the grooves 122 in the first section major surface 106 extend from proximate a first edge 110D, which is opposite edge 110B, towards edge 110B. The grooves 122 in each of the side walls 108A, and 108C, extend from proximate a first edge 124A and 124C of the side walls 108A, 108C, respectively, towards a second edge 126A (not shown), 126C of the side walls 108A, 108C. The second edges 126A, 126C of the side walls 108A, 108C, are opposite the first edges 124A, 124C of the side walls 108A, 108C. Each groove 122 may be 0.25 inches wide, or any other suitable width. The groove 122 may be routed with a fixture and trim router, or by any other suitable means. The grooves 122 may be used to adjustably couple the first section 102 with the second section 104, as will be further described below.

The second section major surface 114 and two of its side walls 116A and 116C may include a plurality of holes 127. The holes 127 are positioned to coordinate with the grooves 112 in the first section. While each surface shown herein includes two holes, the number of holes can be changed as warranted. The holes may be 0.25 inches in diameter. Other diameters may be used. The holes may be drilled with a fixture or may be integrally formed with the cover 100. The holes 127 may be used with the grooves to adjustably secure the first section 102 with the second section 104, as will be further described below. Numerous other methods to be able to adjust the position of the first section in relation to the second section and secure them in a fixed position are readily known to those skilled in the art. A few examples are adhesives, clamps, screws, fasteners, ratchet, nails, etc.

An interior surface 128 of the first section 102, opposite the first section major outer surface 106, may include a first section major surface insulation pad 130. The first section major surface insulation pad 130 may be made from polyethylene foam, or any other suitable material. The first section major surface insulation pad 130 may be sized the same as the interior surface 128. The first section major surface insulation pad 130 may be adhered to the interior surface 128 by any suitable adhesive (e.g. glue, peel and stick backing, etc.). An interior surface 132 of each of the side walls 108A, 108B and 108C of the first section 102, and one of the side walls 116B of the second section 104, also may include a side wall insulation pad 134. The side wall insulation pads 134 may also be made from polyethylene foam, or any other suitable material. The side wall insulation pads 134 may be sized to cover the entire interior surface of the side walls 108A, 108B, 108C and 116B. The side wall insulation pads 134 may also extend approximately 2 inches, or any other suitable length, beyond perimeter edges 136 of the cover 100. Additional insulation pads 131, 133 may be used as the length of the cover 100 is adjusted, as will be further described below.

The first section 102 and the second section 104 of the cover 100 may include slots 138 to receive fasteners to secure the cover 100 to a wall or structure, or directly to an A/C unit 140 or A/C unit sleeve 142, as will be further described below. The slots 139 may for example be in the side walls 108A, 108B, 108C, 116A, 116B, 116C, and may include grommets to seal the opening. For example, side 116B and side 108B may each contain two slots. Any other suitable number and placement of slots 139 may be used.

Figure 8:
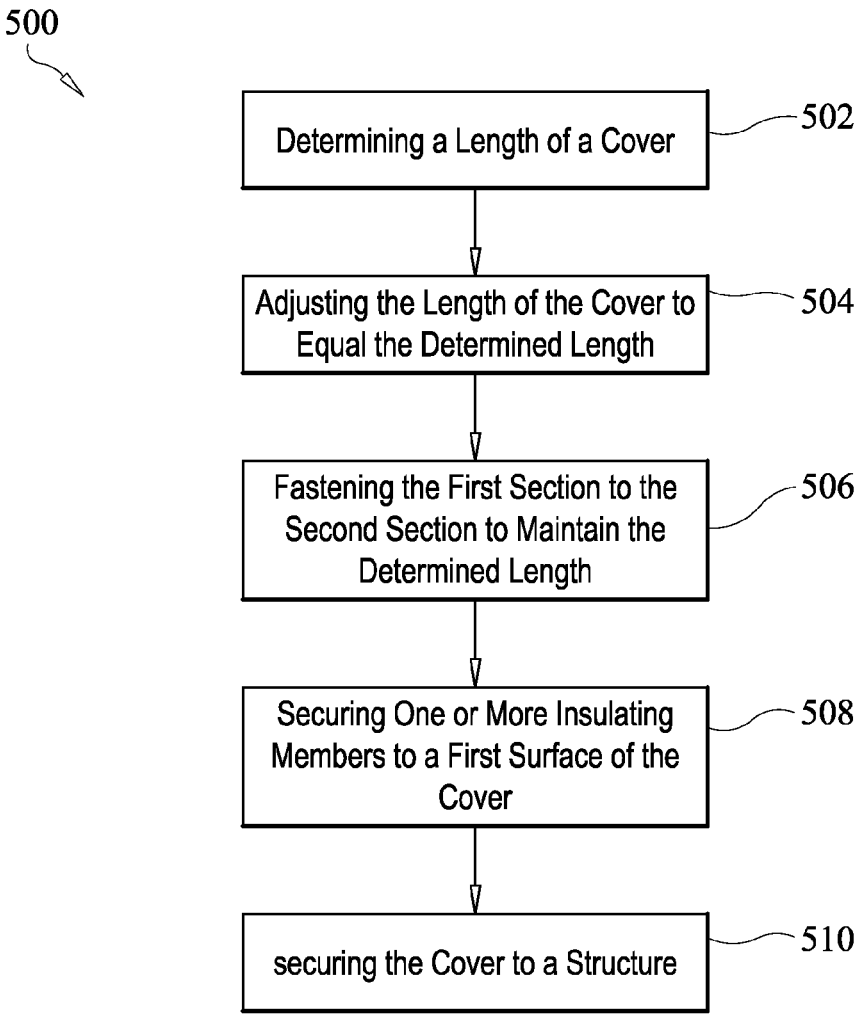
FIG. 8 shows a flowchart illustrating one method of installing the apparatus.

The installation of the cover 100 will now be described in more detail with reference to FIGS. 1-7, and the flowchart FIG. 8 which illustrates a method 500 for securing the adjustable cover 100 according to one or more embodiments. The method 500 includes determining a target length of the cover 100 in step 502. The length of the cover may be determined, for example, by measuring a length of a face of an A/C unit 140 or sleeve 142. The length of the cover 100 may then be adjusted to equal the determined target length in step 504. A typical cover 100 is designed to allow the length/width to be extended to the size of any standard window up to 36 inches wide and 20 inches high. But covers can be designed for other opening sizes as warranted. The length of the cover 100 may be adjusted by movement of the first section 102 relative to the second section 104.

In step 506, fastening devices 141 such as screws, bolts, may be inserted through the holes 127 in the second section 104 and received in the correspondingly aligned groove 122 of the first section 102. This allows the first section 102 to be coupled to the second section 104. The fastening device 141 may slide in the groove 122, allowing the length of the cover 100 to be adjusted. In other words, the fastening device 141 may move back and forth in the groove 122 enabling the cover 100 length to be adjusted. The first section 102 may then be fastened to the second section 104, by tightening the fastening device 141, for example, or by cover fasteners such as nuts, secured to the fastening device, to maintain the determined target length. Other suitable fastening devices and cover fasteners may be used.

In other embodiments, instead of holes 127, the second section major surface 114 and two of the side walls 116A and 116C may include pegs or extensions (not shown), integrally formed with the second section 104. The pegs or extensions may be received in the grooves 122, and secured in place via fasteners, to fix the length of the cover 100.

In step 508, one or more insulating pads 130, may be secured to the cover 100. In one embodiment the first section major surface insulation pad 130 may be adhered to the interior surface 128 of the first section 102 after the first section 102 is fastened to the second section 104. In other embodiments, the first section major surface insulation pad 130 may be integrally formed with the first section 102. Similarly, the side wall insulation pads 134 may be adhered to the side walls 108A, 108B, 108C and 116B of the cover 100 after the first section 102 is fastened to the second section 104, or the side wall insulation pads 134 may be integrally formed with the side walls 108A, 108B, 108C and 116B of the cover 100.

When the cover 100 is expanded to any length, insulation pads 130 and 134 may not be long enough to cover the entire interior of the cover 100. As such, an additional first section major surface insulation pad 131 may be further adhered to an interior surface of the second section 104, and an additional side wall insulation pad 133 may be added to each of side walls 116A and 116C, such that the entire interior surface of the cover 100 is coated by insulation pad. The length of the additional insulation pads 131, 133 may be adjusted by trimming or cutting the additional insulation pads 131, 133 to the desired size/length. In other embodiments, the additional insulation pads 131, 133 may be perforated to facilitate achieving the desired size/length.

In step 510 the cover apparatus 100 is secured to a structure 144 or directly to an A/C unit 140 or sleeve 142. FIGS. 4-7 illustrate a single non-adjustable apparatus and the means to secure them. But the same features for securing apply to both adjustable and non-adjustable apparatus. The structure 144 may be a wall for example, surrounding the sleeve 142, or the window A/C unit 140. The cover apparatus 100 may be placed over the A/C unit 140 or the sleeve 142. The slots 138 in the cover apparatus 100 may receive fasteners 146, such as a bungee cord or other elastic cord. A first end 148 of the fastener 146 may be threaded through the slot 138 and may be prevented from exiting the slot 138 by then securing a tie or any other suitable securing member 149 to the first end 148 of the fastener. A second end 150 of the fastener 146 may be threaded through a receiver 152 secured to the structure 144. In addition to the wall, the structure 144 may also be the window jam. The receiver 152 may be, for example, a hook such as an eye hook, a D-clip, or any other suitable receiver 152.

In other embodiments, the first end 150 may be secured directly to the A/C unit 140 or sleeve 142, by using for example D-clips, screw fasteners, bolt assemblies, holes drilled in the unit/sleeve, spot welded brackets or clips. The second end of the fastener 146 is inserted thought the apparatus cover 100 and secured after pressing the cover 10 against the structure. In additional embodiments the cover 100 may be secured and tightened against the structure 144 or directly to A/C unit 140/sleeve 142 via magnetic fields provided by magnets attached thereto. The cover 100 may be tightened against the structure 144 or directly to A/C unit 140 or sleeve 142 using draw string fasteners or cord locks 153 secured to the second end 150 of the fastener, or any other suitable tightening member. The draw string fasteners or cord locks 153 may be slid into contact against the cover 100 or receiver 152 to maximize tension and aid in sealing the cover 100 against the structure 144. Tightening or press fitting the cover 100 against the structure 144 or directly to A/C unit 140 or sleeve 142 creates a tight seal between the portions of the insulating members 133, 134 that extend beyond the perimeter edges 136 and the structure 144 or sleeve 142. This minimizes or prevents any air from leaking through the A/C unit 140 or the sleeve 142. In one embodiment, the cover 100 is designed to completely air seal the A/C unit 140 or sleeve 142 in heavy winds up to 150 mph. The seal may be improved by running one's finger around the insulating members 133, 134 to smooth out any small air gaps that may be visible.

While the invention is susceptible to various modifications and alternative forms, specific embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents, and alternatives falling within the scope of the invention. For example, in one or more embodiments when the A/C unit 140 is in the window, additional insulation pads may be placed between the two panes of glass to further prevent air leakage from this area. As another example, the A/C unit 140 or sleeve 142 may have an indentation around a perimeter thereof to allow for the cover 100 to be tension mounted thereto. This invention can also be used to cover other openings in a structure such as openings for exhaust fans when not in use or attic stair openings, even windows.

Accordingly, while the present invention has been disclosed in connection with exemplary embodiments thereof, it should be understood that other embodiments may fall within the spirit and scope of the invention, as defined by the following claims.

What is claimed is:

1. An apparatus comprising:

a cover having a first section and a second section, wherein the first section is designed to be secured to the second section;

at least one insulating member positioned along an interior of the cover; and at least one fastener designed to secure the cover over an opening in a structure wherein a position of the first section is adjustable in relation to the second section to change the length of the cover as warranted by the opening in the structure; and one or more grooves in the first section which extend from a proximate first end of the first section to a proximate second end of the first section which is opposite the first end and the second section further comprises one or more openings located to correspond to locations of the grooves in the first section and designed to receive one or more fastening devices.

2. The apparatus according to claim 1 wherein the opening in the structure is designed to house a sleeve and the fastener has a first end designed to be secured to the sleeve and a second end designed to be secured to the cover.

3. The apparatus according to claim 1 wherein the opening in the structure is designed to house an A/C unit and the fastener has a first end designed to be secured to the A/C unit and a second end designed to be secured to the cover.

4. The apparatus according to claim 1 wherein the fastener has a first end designed to be secured to the cover and a second end designed to be secured to the structure.

5. The apparatus according to claim 1 wherein the insulating member forms a seal between the cover and the structure.

6. The apparatus according to claim 1 wherein the insulating member extends beyond an edge of the first and second sections.

7. The apparatus according claim 1 wherein the insulating member extends along an entire interior of the cover.

8. The apparatus according to claim 1 wherein the fastener is an elastic cord.

* * * * *